US005826600A

United States Patent [19]

Rowe et al.

[11] Patent Number: 5,826,600

[45] Date of Patent: Oct. 27, 1998

[54] DISPOSABLE DRY-HANDLE MASCARA APPLICATOR ASSEMBLY

[75] Inventors: John P. Rowe, Antioch; Darrell W. Van Dyke, Libertyville, both of Ill.

[73] Assignee: National Healthcare Products, Ltd., Antioch, Ill.

[21] Appl. No.: 904,803

[22] Filed: Sep. 29, 1997

[51] Int. Cl.[6] ..... A45D 40/24

[52] U.S. Cl. ..... 132/317; 132/320; 401/122; 401/129; 206/362.3

[58] Field of Search ..... 604/1, 128, 202, 604/204, 212, 158, 164, 51; 132/317, 314, 318, 320, 294, 295, 296, 297, 315; 128/749, 759; 401/122, 129, 132; 206/210, 209.1, 65.5, 362.3; 15/172, 164

[56] References Cited

U.S. PATENT DOCUMENTS

| | | | |
|---|---|---|---|
| 3,214,782 | 11/1965 | Masters et al. | 401/122 |
| 3,262,461 | 7/1966 | Kambersky | 401/129 |
| 3,776,220 | 12/1973 | Monaghan | 401/132 |
| 4,586,604 | 5/1986 | Alter | 206/210 |
| 4,749,655 | 6/1988 | Monthony et al. | 604/1 |
| 4,886,080 | 12/1989 | Cole | 132/317 |
| 4,952,204 | 8/1990 | Korteweg | 604/1 |
| 4,982,838 | 1/1991 | Fitjer | 132/317 |
| 5,137,038 | 8/1992 | Kingsford | 32/317 |

*Primary Examiner*—Gene Mancene
*Assistant Examiner*—Pedro Philogene
*Attorney, Agent, or Firm*—Azulay & Azulay

[57] ABSTRACT

A disposable mascara applicator assembly has a mascara brush-applicator that is completely contained in first and second plastic casing-sections, with the casing-sections being filled with mascara. The first and second casing-sections are capable of being broken away from each other along a fault connecting section therebetween, with the second casing-section having an end-portion adjacent to the fault connecting section that has a reduced inner-diameter end-section having an inner diameter less than the outer diameter of the brush-applicator end-portion of the mascara applicator, whereby, after the first and second casing-sections have been broken away from each other, the mascara applicator may be pulled through and out of the second casing via the opening formed during the severing process, which opening lies adjacent the reduced inner diameter end-section, which reduced inner diameter end-section serves as a wiper-section for wiping off excess mascara from the brush-applicator end-portion as the brush-applicator end-portion is pulled therethrough.

16 Claims, 3 Drawing Sheets

DISPOSABLE DRY-HANDLE MASCARA APPLICATOR ASSEMBLY

BACKGROUND OF THE INVENTION

The present invention is directed to a disposable mascara applicator, which is based on the dry-handle swab applicator disclosed in commonly-owned U.S. Pat. No. 4,952,204, the disclosure of which is incorporated by reference herein. In said commonly-owned patent, there is disclosed a swab applicator containing a swab having an applicator-portion at one end for applying medicine, cosmetics, and the like. A handle section extends from the applicator-portion, which handle portion is snugly and completely surrounded by a first outer casing-section of plastic. The applicator-portion is also surrounded by a second outer casing-section of plastic integrally formed with the first outer casing-section that snugly and completely surrounds the handle portion. The swab applicator is completely enclosed within the outer casing-sections, with the second outer casing-section being filled with the substance to be applied by the swab applicator. The first and second plastic casing-sections are joined at a fault line or section which allows easy severance or separation of the first and second casing-sections, when the swab applicator is to be used by a person for applying the substance contained therein. When the second casing-section is broken away from the first casing section, the applicator end-portion of the swab applicator becomes exposed, while the first casing-section remains entrained about the handle portion of the swab applicator, in order to serve as a dry handle. The applicator-portion of the swab applicator of U.S. Pat. No. 4,952,204 is typically comprised of a cotton bud, or the like. The substance to be applied is, therefore, daubed on, which is a method generally not suitable for the application of mascara to eyelashes, which, for all intents and purposes, requires a small brush-applicator.

SUMMARY OF THE INVENTION

It is, therefore, the primary objective of the present invention to provide a disposable mascara applicator-assembly containing a disposable mascara applicator which is completely contained in a first and second plastic casing-sections, which applicator is provided with a brush-applicator end-portion rather than a daubing end-portion.

It is also a primary objective of the present invention to provide a disposable mascara applicator-assembly having a disposable mascara applicator which is completely contained in first and second plastic casing-sections, and which applicator assembly is filled with mascara, with the mascara applicator being provided with a brush-applicator end-portion rather than a daubing end-portion, and which first and second casing-sections are capable of being broken away from each other along a fault connecting-section therebetween, with the second casing-section having an end-portion adjacent to the fault connecting-section that has a reduced inner-diameter end-section having an inner diameter less than the outer diameter of the brush-applicator end-portion of the mascara applicator, whereby, after the first and second casing-sections have been broken away from each other, the mascara applicator may be pulled through and out of the second casing via the opening formed during the severing process, which opening lies adjacent the reduced inner diameter end-section, which reduced inner diameter end-section serves as a wiper-section for wiping off excess mascara from the brush-applicator end-portion as the brush-applicator end-portion is pulled therethrough.

BRIEF DESCRIPTION OF THE DRAWINGS

The invention will be more readily understood with reference to the accompanying drawing, wherein.

DETAILED DESCRIPTION OF THE INVENTION

Figure 1:
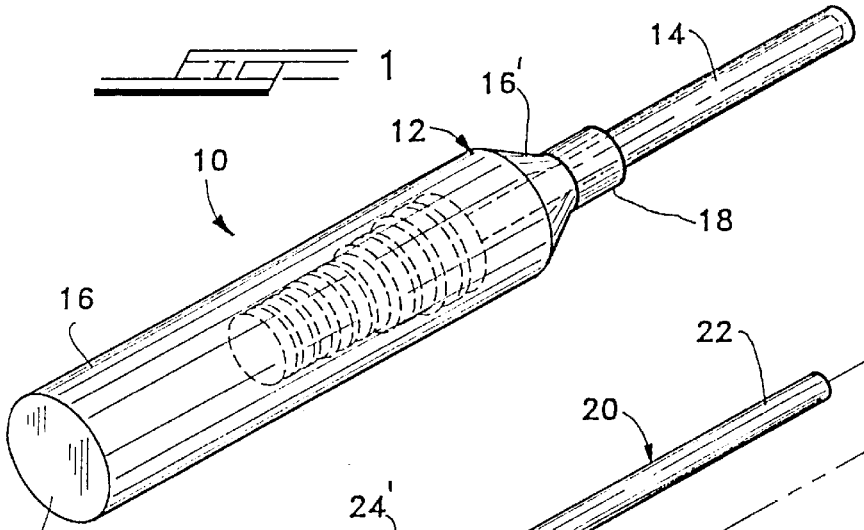
FIG. 1 is an isometric view of the disposable, dry-handle, mascara applicator assembly of the invention.
Figure 2:
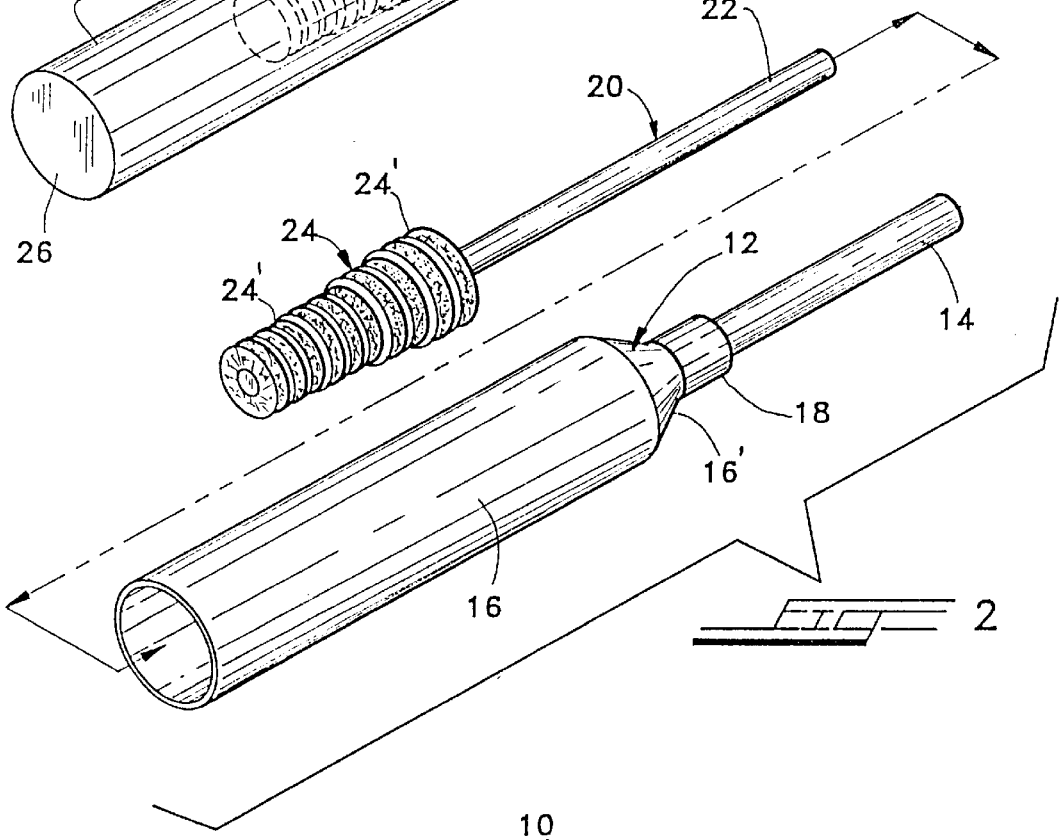
FIG. 2 is an assembly view showing the parts of the disposable, dry-handle, mascara applicator assembly of the invention.
Figure 3:
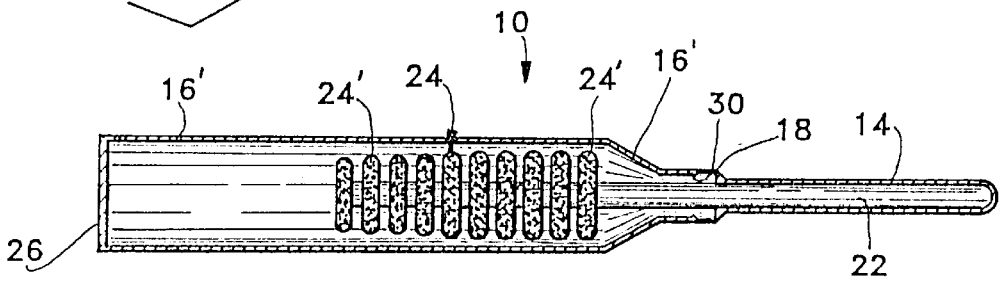
FIG. 3 is a longitudinal cross-section view thereof.
Figure 4:
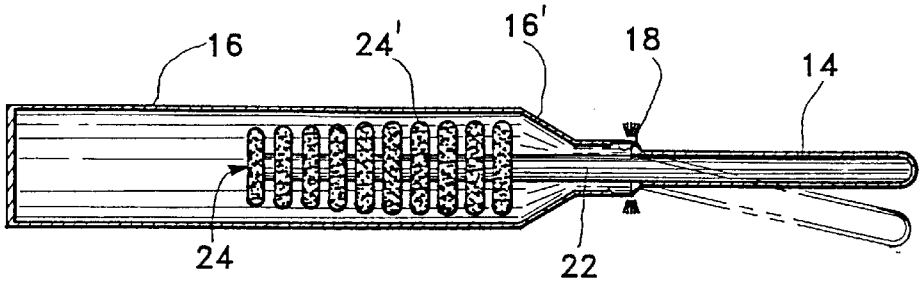
FIGS. 4–6 are plan views showing the stages of severing the outer casing and removing the interior mascara-brush applicator.
Figure 5:
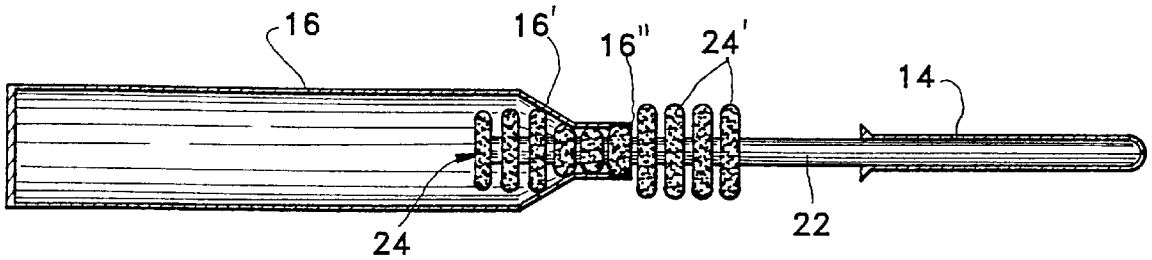
Figure 6:
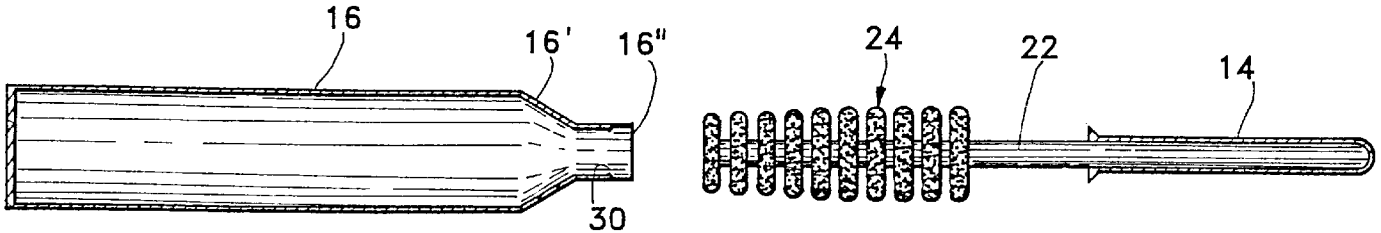
Figure 7:
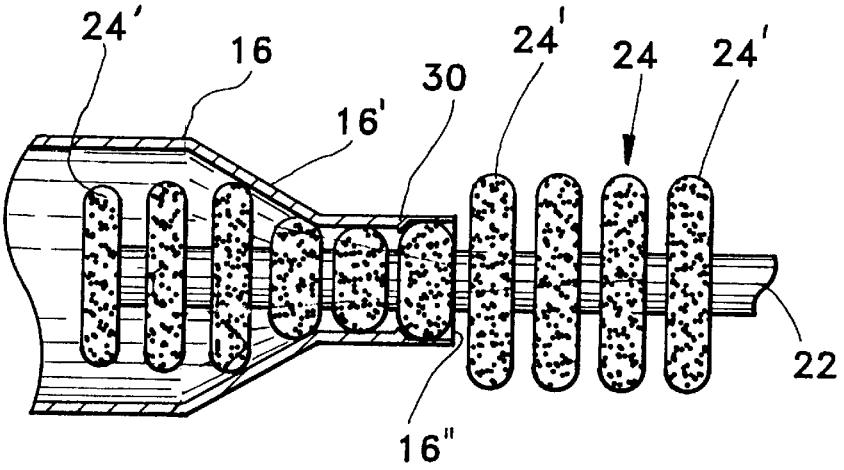
FIG. 7 is a detail view, in partial cross section, showing the removal of the brush-element of the interior mascara-brush applicator from a portion of the casing for wiping off excess mascara from the brush-element.

Referring now to the drawings in greater detail, the disposable, dry-handle, mascara applicator-assembly of the invention is indicated generally by reference numeral 10. The disposable, dry-handle, mascara applicator-assembly of the invention consists of a frangible outer casing or housing 12 preferably made of thermoplastic material. The outer casing 12 consists of two sections: a first, handle-section 14, and a second, larger, receiving-section 16; the second receiving-section 16 has a substantially frustoconical-shaped end-portion 16', which preferably has at least a portion having an inner diameter less than the outer diameter of the bristles of the brush-element being pulled out, as set forth in greater detail hereinbelow. The first and second sections are integrally joined to each other via an intermediate, frangible section 18 which is a thinner, reduced portion that allows relatively easy fracture or separation of the outer casing 12 thereat, in manner similar to that described in U.S. Pat. No. 4,952,204. The outer casing houses a disposable mascara applicator 20 consisting of a handle-portion 22 and an applicator end-portion 24. The applicator end-portion 24 is constituted by a mascara brush-element for applying mascara to eyelashes, and is provided with a series of flexible bristles 24'. The handle-portion 22 is contained within the first, handle-section 14 of the casing, which handle-portion 22 also, in the preferred embodiment, extends into the interior of the second casing-section 16, although the handle-portion 22 may be completely contained within the first handle-section 14. The first handle-section 14 of the casing 10 preferably snugly surrounds the handle-portion 22, as set forth in U.S. Pat. No. 4,952,204, so as to provide a dry handle for holding the mascara applicator 20 after the outer casing 12 has been broken at the intermediate frangible section 18, and separated into its first and second sections 14, 16. The applicator end-portion or brush-element 24 is located or housed within the second receiving casing-section 16, which casing-section 16 is preferably filled with mascara before the end-surface 26 has been closed off during manufacture, as set forth in detail in U.S. Pat. No. 4,952,204.

As noted above, the first and second casing-sections 14, 16 are severable along the intermediate frangible section 18. This intermediate frangible section is located directly adjacent, and in close juxtaposition, to a reduced-diameter, inwardly-projecting annular ring or bead 30, that preferably has an inner diameter less than the outer diameter of the brush-element 24 as measured along the exterior tips of the bristles 24' thereof, but greater than the outer diameter of the handle-section 22 of the mascara applicator. This annular ring defines an interiorly-narrowing circumferential surface terminating in a vertex 30', which provides greater effectiveness in wiping the excess mascara from the brush-bristles. After the first and second casing-sections have been separated via the intermediate frangible section by means of force applied to these sections, as set forth in U.S. Pat. No. 4,952,204, the end of the second casing-section 16 is exposed by means of a hole or opening 16' thereat, which lies directly adjacent, and in close juxtaposition, to the reduced-diameter, inwardly-projecting annular ring or bead 30. Thus, the brush-element 24 may be removed from within the interior of the second casing-section 16 by pulling on the first, handle casing-section 14 that snugly receives therein the handle-portion 22 of the mascara applicator, by removing the brush-element 24 through the reduced-diameter, inwardly-projecting annular ring or bead 30 and through the exposed end or opening 16' of the second casing-section. As the brush-element 24 is pulled out of the second casing-section, the frustoconical end-portion 16' starts to the compress or wipe off excess mascara at the portion thereof that has an inner diameter less than the outer diameter of the bristles of the brush-element, and, then, as the bristles are pulled through the reduced-diameter, inwardly-projecting annular ring or bead 30, the bristles are squeezed or forced through, such that any excess mascara on the bristles 24' is removed, so that the mascara may be applied to the eye lashes in a more neat and sanitary manner, and without spillage or over-application of mascara, as can be seen in FIGS. 4–7.

Figure 8:
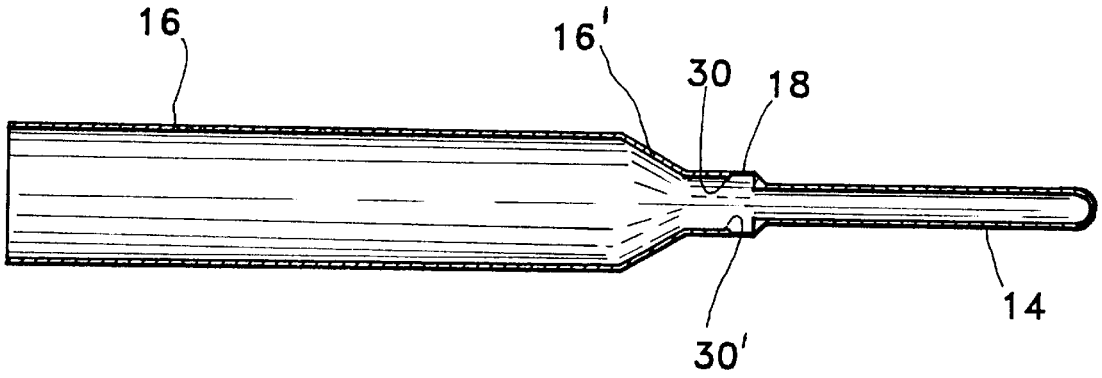
FIG. 8 is a detailed, longitudinal cross-section view showing the dimensions of the outer casing and in particular the dimensions of the reduce-diameter annular ring for wiping off excess mascara and the frangible section at which the outer casing is severed into two sections.

In the preferred embodiment, as seen in FIG. 8, the disposable, dry-handle, mascara applicator assembly 10 of the invention has an overall length of between 3.1 to 3.2 inches, as measured longitudinally axially along the outer casing 12. The reduced-diameter annular ring 30 defines an interior wiping area of .15 inch diameter. The frangible section 18 defines a wall thickness of between .003–.007 inches, as compared to .014–.019 inches for the second casing-section 16 and .009–.015 inches for the first handle casing-section 14. As can be seen in FIG. 8, the second casing need not be perfectly cylindrical, but may be slightly frustoconical in shape, with the inside diameter at the end thereof farthest away from the first casing-section being preferably about .010 inches greater that the beginning of the substantially frustoconical-shaped end-portion 16' of the second casing-section. It is also within the scope and purview of the invention to effect the wiping of the bristles of the brush-element solely by the frustoconica end-portion 16' of the second casing-section for those applications where a higher degree of wiping of the bristles is not a concern.

For purposes of this disclosure, the term brush-element is also meant to constitute an applicator end-portion 24 made of a mascara-applying comb-element with flexible comb-elements. In addition, it is within the scope and purview of the invention to space the reduced-diameter, inwardly-projecting annular ring or bead 30 farther away from the intermediate frangible section 18, and to substitute for the reduced-diameter, inwardly-projecting annular ring or bead 30 a partially-arcuately extending projection. It is also within the scope and purview of the invention to provide and store any substance within the outer casing 12 of the invention other than mascara which may be applied by a brush element 24, which substance may be other makeup that is applied by brush or comb.

While a specific embodiment of the invention has been shown and described, it is to be understood that numerous changes and modifications may be made therein without departing from the scope, spirit and intent of the invention as set forth in the appended claims.

What I claim is:

1. In an applicator assembly comprising an outer casing having a first casing-section and a second casing-section, and a frangible section interconnecting said first and second casing-sections at which said first and second casing-sections may be broken away from each other, and applicator means contained in said casing, said applicator means comprising an applicator end-portion for applying a substance, and a handle portion extending from said applicator end-portion, the improvement comprising:

said applicator end-portion comprising mascara-applicator means for applying mascara to eyelashes;

said second casing-section comprising a reduced inner-diameter section spaced from said frangible section interconnecting said first and second casing-sections the inner diameter of said reduced inner-diameter section being less than the outer diameter of said mascara-applicator means, whereby, after said first and second casing sections have been broken apart at said frangible section. said applicator end-portion may be pulled through said reduced inner-diameter section of said second casing section for wiping off excess mascara therefrom.

2. The applicator assembly according to claim 1, wherein said casing is at least partially filled with mascara.

3. The applicator assembly according to claim 1, wherein said applicator end-portion comprises one of a brush and comb for applying the mascara.

4. The applicator assembly according to claim 1, wherein said reduced inner-diameter section is located in close juxtaposition to said frangible section.

5. The applicator assembly according to claim 1, wherein said reduced inner-diameter section of said second casing section comprises an interior bead projecting into the hollow interior of said casing.

6. The applicator assembly according to claim 5, wherein said casing has a central longitudinal axis; said interior bead comprising an annular ring having a central longitudinal axis that is substantially colinear with the central longitudinal axis of said casing.

7. The applicator assembly according to claim 1, wherein said second casing-section comprises a substantially frustoconical end-portion connected to said frangible section, said reduced inner-diameter section being part of said frustoconical end-portion.

8. In an applicator assembly comprising an outer casing having a first casing-section and a second casing-section, and a frangible section interconnecting said first and second casing-sections at which said first and second casing-sections may be broken away from each other, and applicator means contained in said casing, said applicator means comprising an applicator end-portion for applying a substance, and a handle portion extending from said applicator end-portion, the improvement comprising:

said applicator end-portion comprising brush-applicator means for applying a substance that requires the application thereof by means of a brushy;

said second casing section comprising a reduced inner-diameter section spaced from said frangible section interconnecting said first and second casing-sections. the inner diameter of said reduced inner-diameter section being less than the outer diameter of said applicator end-portion, whereby, after said first and second casing sections have been broken apart at said frangible section, said applicator end-portion may be pulled through said reduced inner-diameter section of said second casing section for wiping off excess substance therefrom.

9. The applicator assembly according to claim 8, wherein said casing is at least partially filled with said substance to be applied.

10. The applicator assembly according to claim 8, wherein said reduced inner-diameter section is located in close juxtaposition to said frangible section.

11. The applicator assembly according to claim 8, wherein said reduced inner-diameter section of said second casing section comprises an interior bead projecting into the hollow interior of said casing.

12. The applicator assembly according to claim 11, wherein said casing has a central longitudinal axis; said interior bead comprising an annular ring having a central longitudinal axis that is substantially colinear with the central longitudinal axis of said casing.

13. The applicator assembly according to claim 8, wherein said reduced-diameter section comprises an interior annular ring, said annular ring comprising sloping side surfaces and terminating at an interior vertex for wiping excess substance from said brush-applicator means.

14. In an applicator assembly comprising an outer casing having a first casing-section and a second casing-section, and a frangible section interconnecting said first and second casing-sections at which said first and second casing-sections may be broken away from each other, and applicator means contained in said casing, said applicator means comprising an applicator end-portion for applying a substance, and a handle portion extending from said applicator end-portion, the improvement comprising:

said applicator end-portion comprising brush-applicator means for applying a substance that requires the application thereof by means of a brush;

said second casing-section comprising a substantially frustoconical end-portion connected to said frangible section and having at least a portion thereof that comprises an inner diametric extent less than the outer diameter of said brush-applicator means, whereby as said brush-applicator means is pulled through said substantially frustoconical end-portion, said brush-applicator means is at least partially wiped clean of excess substance being applied thereby.

15. A method of using an applicator assembly comprising an outer casing having a first casing-section and a second casing-section, and a frangible section interconnecting said first and second casing-sections at which said first and second casing-sections may be broken away from each other, and applicator means contained in said casing, said applicator means comprising an applicator end-portion for applying a substance, and a handle portion extending from said applicator end-portion, said applicator end-portion comprising brush-applicator means for applying a substance that requires the application thereof by means of a brush, said method comprising the steps of:

(a) breaking the outer casing apart into separated said first and second casing-sections at said frangible section;

(b) removing said applicator means from said second casing-section;

(c) said step (b) comprising pulling said applicator end-portion through an opening formed in said second casing-section when said step (a) was performed;

(d) said step (c) comprising removing excess substance from said applicator end-portion as said applicator end-portion is pulled through said openings;

further comprising prior to said step (a), forming said casing with said first and second casing-sections, and forming said second casing-section with a reduced diameter portion; said step (a) exposing said reduced diameter portion to form the opening of said step (c), whereby said step (b) may be performed.

16. The method according to claim 15, further comprising prior to said step (a), filling the interior of said casing with said substance to be applied.

* * * * *